US005413467A

United States Patent [19]

Suzuki

[11] Patent Number: 5,413,467

[45] Date of Patent: May 9, 1995

[54] OIL-FREE TYPE SCREW COMPRESSOR DEVICE

[75] Inventor: Akira Suzuki, Shimizu, Japan

[73] Assignee: Hitachi, Ltd., Tokyo, Japan

[21] Appl. No.: 75,804

[22] Filed: Jun. 14, 1993

Related U.S. Application Data

[63] Continuation of Ser. No. 825,094, Jan. 24, 1992, abandoned.

[30] Foreign Application Priority Data

Jan. 24, 1991 [JP] Japan ..... 3-007075

[51] Int. Cl.[6] ..... F04B 23/14

[52] U.S. Cl. ..... 417/203; 417/205; 418/201.1

[58] Field of Search ..... 417/203, 205; 60/609; 418/201

[56] References Cited

U.S. PATENT DOCUMENTS 2,849,173 8/1958 Surdy ..... 417/203

3,141,604 7/1964 Williams ..... 417/203

4,487,563 12/1984 Mori et al. ..... 418/201

OTHER PUBLICATIONS

Paper 19 "The Oil-Free Screw Compressor", P. O'-Neill & W. Beatts; Proc. Instn. Mech. Engrs., vol. #184, 1969–1970.

*Primary Examiner*—Richard A. Bertsch

*Assistant Examiner*—Roland G. McAndrews, Jr.

*Attorney, Agent, or Firm*—Antonelli, Terry, Stout & Kraus

[57] ABSTRACT

A device for producing compressed air arranged to suction air from the atmosphere an increase the pressure of the suctioned air by a turbo-supercharger, to cool the air at high temperature by passing the air through an intercooler and to compress the air to a required pressure by an oil-free screw compressor having an air inlet port connected to the intercooler. The compressed air discharged from the compressor is cooled by coolers and then delivered to a user side.

2 Claims, 5 Drawing Sheets

OIL-FREE TYPE SCREW COMPRESSOR DEVICE

This is a continuation of application Ser. No. 825,094 filed Jan. 24, 1992, now abandoned.

BACKGROUND OF THE INVENTION

1. Field of the Invention

The present invention relates to an oil-free compressor arrangements and, more particularly, to a compressor arrangement including an oil-free screw compressor and a turbo-supercharger to produce a clean compressed air free of oil mist.

2. Description of the Prior Art

An oil-free type screw compressor includes a male rotor and a female rotor which is rotated, while maintaining a non-contact meshing relationship with each other, that is, a slight clearance is maintained between the male rotor and the female rotor at all times during rotation, with a casing forming a compression space in which said male rotor and said female rotor are housed, while a slight clearance is maintained at all times between. The rotors and said casing, said screw compressor is arranged so as to supply no oil into the compression space for lubrication, cooling and sealing purposes. The oil-free type screw compressor of this type has been conveniently employed to produce a clean compressed air free of oil mist.

The present invention is not directed to the construction of the oil-free screw compressor itself; however to facilitate an understanding of the present invention, an explanation will be given to the construction of the oil-free screw compressor before describing the present invention.

In an oil-free type screw compressors, no oil is supplied to the compression space in which rotors are housed, but there is the risk of the oil for lubricating the bearings for journalling the rotors entering the compression space. The oil tends to enter the compression space through clearances between the shafts connected to the rotors and the wall of the casing enclosing the shafts. Thus, has been the usual practice to provide oil shield means between the shafts and the compression space.

FIGS. 1 to 6 show a single stage, oil-free screw compressor, as disclosed in U.S. Pat. No. 4,487,563.

A male rotor 1 including a gear thread 1*a* and shaft portions 12*a* and 12*c* and a female rotor 2 including a gear thread 2*a* and shaft portions 12*b* and 12*d* are located in a compression space defined by a casing while being maintained in meshing engagement with each other.

The casing includes a main casing 3, a suction-side casing 4 is connected to the main casing 3 through bolts and an end cover 5 is also connected to the main casing 3 through bolts, with the main casing 3 defining the compression space in the form of two cylindrical bores intersecting each other.

The shaft portions 12*a* and 12*c* of the male rotor 1 and the shaft portions 12*b* and 12*d* of the female rotor 2 penetrate the casing, and shaft sealing means 8*a*, 8*b*, 8*c* and 8*d* are mounted on the shaft portions 12*a*, 12*b*, 12*c* and 12*d* respectively in positions where they penetrate the casing. The shaft sealing means 8*a*, 8*b*, 8*c* and 8*d* are located near the rotors for sealing the shafts to prevent compressed gas (compressed air) from leaking to outside from the compression space and keep oil for lubricating bearings from entering the compression space from the bearings.

The two rotors 1 and 2 are supported by the casing through radial bearings 6*a*, 6*b*, 6*c* and 6*d* for bearing radial loads and by thrust bearings 7*a*, 7*b*, 7*c* and 7*d* for bearing thrust loads.

A pair of meshing timing gears 9 and 10 are mounted on the discharge-side shaft portions of the rotors 1 and 2, to enable the rotors 1 and 2 to rotate while being out of contact with each other. A pinion 11 is mounted on the end of the suction-side shaft portion 12*a* of the male rotor 1 and driven by a pull gear (not shown). When motive force is transmitted from a drive source to the pinion 11, the male and the female rotors 1 and 2, forming a pair, are rotated in synchronism with each other through the timing gears 9 and 10 while being spaced apart from each other by a small clearance. As a result, gas (air) is drawn by suction through a suction passageway 31 and a suction port (not shown) into a compression chamber defined between the screw threads 1*a* and 2*a* of the rotors 1 and 2. As the rotors 1 and 2 rotate, communication between the compression chamber and the suction port is shut off and the compression chamber gradually becomes smaller in volume, so that the gas (air) in the compression chamber is compressed and discharged though a discharge port (not shown) to be used for various purposes. A cooling jacket 32 is formed in the casing 3 so that the jacket 32 surrounds the compression space, and a coolant, such as water, supplied from outside is circulated through the cooling jacket 32.

FIG. 3 shows in detail the shaft portion 12*b* of the female rotor 2 on its suction side. The rotors 1 and 2 are of substantially the same construction, so that description of the shaft portion 12*a* of the male rotor 1 on its suction side shall be omitted. A sealing means 13 of a non-contact type seals the shaft portions against gas (air), the non-contact type sealing means comprising rings formed of carbon or resin, with such as tetrafluoroethylene, and arranged in a side-by-side relationship. The radial roller bearing 6*b* receives a supply of lubricant delivered in jets through an oil feed duct 28 and a port 30 formed in a bearing support 29. After passing the bearing 6*b*, a major portion of the lubricant is discharged through an oil discharge duct 26. A suction end 24 of the compression space in which the rotors 1 and 2 are located is at a negative pressure at all times and the negative pressure is enhanced during a no-load operation. Thus, air is drawn at all times to a space 55 by suction through an atmosphere communicating duct 16 and a plurality of ports 15 formed in a lantern ring 14, so that the space 55 defined between the lantern ring 14 and the shaft portion 12*b* is at a negative pressure at all times and the negative pressure becomes enhanced during a no-load operation. Thus, it is necessary to use oil shield means of high sealing ability to prevent the oil discharged from the bearing 6*b* from being drawn by suction into the compression space. To this end, there is used screw seal means capable of performing a satisfactory sealing function through a pumping action when the shafts are rotated. The screw seal has a sealing ability which is substantially in inverse proportion to the radial clearance between the shaft and the screw seal, so that a screw seal ring 21 of a floating type is used to minimize the radial clearance.

The screw seal ring 21 is formed on its inner surface with a spiral screw thread 23 and a thread root 22 as shown in FIG. 4. As the shaft portion 12*b* rotates in the direction of an arrow in FIG. 3, the gas (air) in the thread root 22 is pulled due to its viscosity and flows from the space 55 in the direction of the bearing 6b while performing a pumping action to discharge the oil in the direction of the bearing. The screw seal ring 21 is pressed by a corrugated spring or coil spring 20 against the lantern ring 14 into end-to-end contact. Since the seal ring 21 is radially movable, the seal ring 21 can be prevented from coming into contact with the shaft portion **12*b* if the clearance between the seal ring 21 and the shaft portion 12*b* is slightly larger than the radial clearance of the bearing 6*b*, thereby enabling the seal ring 21 to have a high sealing ability. A ring 18 is formed with an oil discharge port 25, and an O-ring 17 is mounted between the lantern ring 14 and the ring 18 to prevent the oil from leaking to an outer periphery of the lantern ring 14**.

FIG. 5 shows in detail the shaft portion **12*d* of the female rotor 2 on its discharge side. The rotors 1 and 2 are of substantially the same construction, so that description of the shaft portion 12*c* of the male rotor 1 on its discharge side shall be omitted. A sealing means 40 of the non-contact type seals the shaft portions against gas (air), with the sealing means 40 being of the same construction as the sealing means 13. The radial roller bearing 6*d* and the thrust roller bearing 7*b* receive a supply of lubricant delivered in jets through an oil feed duct 49 and small ports 51 and 52 formed in an oil feed ring 50. After passing the bearing 6*d*, a major portion of the lubricant is discharged through an oil discharge duct 48. A discharge end 56 of the compression space is at a positive pressure (higher than the atmospheric pressure) at all times, so that a portion of the gas (air) is released to the atmosphere through the gas sealing means 40 from an atmosphere communicating duct 46. Thus, the pressure in a space 57 is positive at all times, and there is no risk of the oil being drawn by suction into the compression space. However, it is necessary to provide means for preventing the oil from leaking to outside through the atmosphere communicating duct 46 after passing the bearings 6*d*. The seal ring means for the shaft portions on the discharge side need not have a high sealing ability, so a radially stationary type screw seal ring 42 of a relatively large radial clearance is used. As shown in FIG. 6, the screw seal ring 42 is formed on its inner surface with a spiral screw thread 44 and a thread root 45. As the shaft portion 12*d* rotates in the direction of an arrow shown in FIG. 5, the seal ring 42 performs a sealing function by its pumping action. An O-ring 53 is mounted on an outer periphery of the screw seal ring 42 to prevent the oil from leaking to outside through the clearance between the casing 3 and the outer peripheral surface of the seal ring 42. The screw seal ring 42 is formed with a plurality of ports 43 for releasing gas (air) to the atmosphere. The shaft sealing means 40 and the screw seal ring 42 are pressed against a snap ring 47 by a corrugated spring 41**.

From the foregoing description, it will be appreciated that the oil-free screw compressor is capable of avoiding entry of lubricating oil for the bearings into the compression space, to produce oil-free air under high pressure.

The conventional oil-free screw compressor is constructed as a single stage oil-free screw compressor which is arranged to directly suction air from the atmosphere into the compressor, as shown in Japanese Patent Publication No. Hei 1-44917 or U.S. Pat. No. 4,487,563.

FIG. 7 illustrates a device of the prior art for producing a compressed air by using a single stage type oil-free screw compressor. The oil-free screw compressor 101 suction atmospheric air through its inlet port **101*a*, compresses the air to a predetermined pressure (usually 7 $Kg/cm^2$ G, where G indicates a gauge pressure) and discharges the compressed air through its outlet port 101*b* and feeds it through a discharge pipe 102 to a precooler 103, which acts to cool the compressed air. The compressed air, which cooled by the precooler 103, is fed through a check valve 104 to an aftercooler 105, to further cool the compressed air, is delivered through an outlet pipe 108 to a user side. As shown in FIG. 7, an oil cooler for cooling 106 cools the oil to be fed to the rotor shaft bearings and other portions to be lubricated in the compressor 101; with a coolant cooler 107 being provided for cooling the coolant to be fed into the cooling jacket 32 (FIGS. 1 and 2) of the compressor 101. A cooling fan 109 cools the above-mentioned coolers, and an air outlet opening 110 is provided though which the air from the fan 109** is discharged.

In general, it is required to produce a clean and oil-free compressed air having a pressure in the order of about 7 $Kg/cm^2$ G. On the other hand, the oil-free screw compressor is required to deal with a considerable increase of temperature due to compression of air, since there is no lubricant oil in the compression space and, consequently, no cooling effect is produced by the lubricant oil.

In the conventional single-stage oil-free screw compressor, the pressure is increased to 7 $Kg/cm^2$ G by the single stage, so that the temperature of the discharged air is increased to a considerably high temperature such as 320° C.–380° C. Accordingly, it has been required to increase the clearance between the rotors in order to prevent the rotors from contacting with each other due to their thermal expansions, resulting in the total adiabatic efficiency of the compressor being decreased to 50–55%, thereby lowering the performance of the compressor. Furthermore, the temperature of the discharged air is considerably high so that tolerance of the machine is low and material of the machine is limited and, consequently, reliability of the machine is deteriorated.

OBJECT OF THE INVENTION

It is an object of the present invention to eliminate the disadvantages of the conventional oil-free screw compressor as described above and to provide an oil-free screw compressor device for producing an oil-free compressed air in which a required compression ratio of the oil-free screw compressor is lowered so that the temperature of the discharged air is decreased, whereby the clearance between the rotors of the compressor can be decreased and the limitation concerning the material used can be reduced with the result that the reliability and the performance of the oil-free screw compressor can be improved.

SUMMARY OF THE INVENTION

In order to attain the above object, the present invention provides an oil-free screw compressor device for producing a compressed air from the atmosphere comprising an oil-free screw compressor having an air inlet port and a compressed air delivering port; and a turbo-supercharger for suctioning air from the atmosphere and increasing the pressure of the suctioned air, with the turbo-supercharger having an air discharge port connected to the air inlet port of the oil-free screw compressor.

The present invention further provides an oil-free screw compressor device for producing a compressed air from the atmosphere, comprising: an oil-free screw compressor having an air inlet port and a compressed air delivering port and a turbo-supercharger for suctioning air from the atmosphere and increasing the pressure of the suctioned air, with the turbo-supercharger having an air discharge port with an intercooler being connected between the air discharge port of the turbo-supercharger and the air inlet port of the oil-free screw compressor.

In a preferred embodiment, the present invention provides an oil-free screw compressor device of the above type wherein the pressure of the air suctioned from the atmosphere is increased to 2,000–5,000 mmAq by the turbo-supercharger.

In the oil-free type screw compressor device according to the present invention, the air from the atmosphere is increased in pressure under the action of the turbo-supercharger and then the air is compressed by the oil-free screw compressor to a required pressure to form a compressed air under high pressure, which is discharged from the compressor. Thus, the compression ratio of the oil-free screw compressor required to attain the required pressure of the compressed air can be reduced and the temperature of the discharged air can be lowered. In the construction in which the air is passed through the above-mentioned intercooler, the air discharged from the turbo-supercharger is cooled by the intercooler and then fed into the oil-fee screw compressor, so that the temperature of the air discharged from the compressor can be further lowered.

The invention will be further explained with reference to the drawings.

DESCRIPTION OF PREFERRED EMBODIMENT OF THE INVENTION

Figure 7:
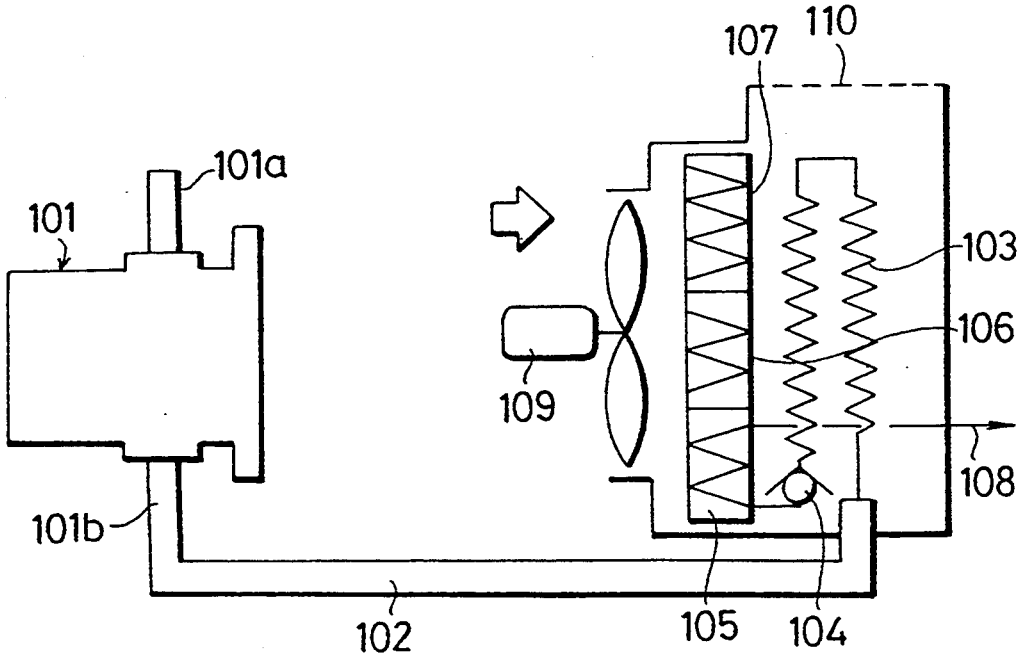
FIG.7 PRIOR ART
FIG. 7 illustrates a conventional single stage oil-free screw compressor device.
Figure 8:
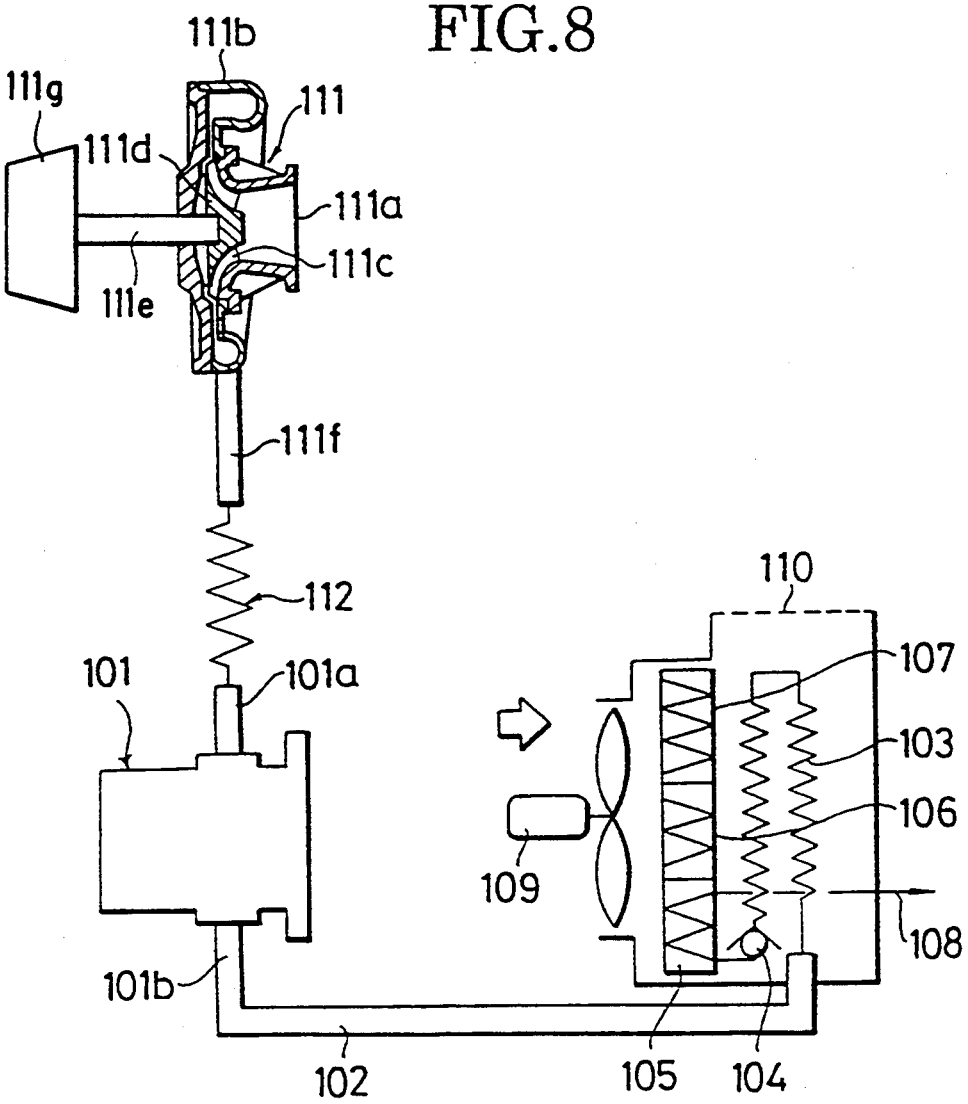
FIG. 8 illustrates an embodiment of the oil-free screw compressor device according to the present invention.

The oil-free screw compressor itself may be same as the conventional oil-free screw compressor, such as shown in U.S. Pat. No. 4,487,563. In FIG. 8, the same parts as those shown in FIG. 7 are designated by the same numerals as used in FIG. 7.

As shown in FIG. 8, the oil-free screw compressor device according to the present invention includes an oil-fee screw compressor 101, and a turbo-supercharger 111 which is connected through an intercooler 112 to a suction side of said oil-free screw compressor 101.

Figure 4:
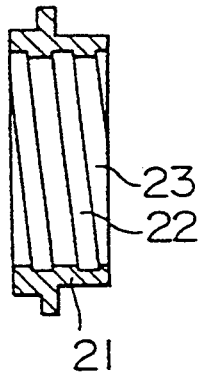
FIG.4 PRIOR ART
FIG. 4 is a sectional view of the floating screw seal ring shown in FIG. 3.
Figure 5:
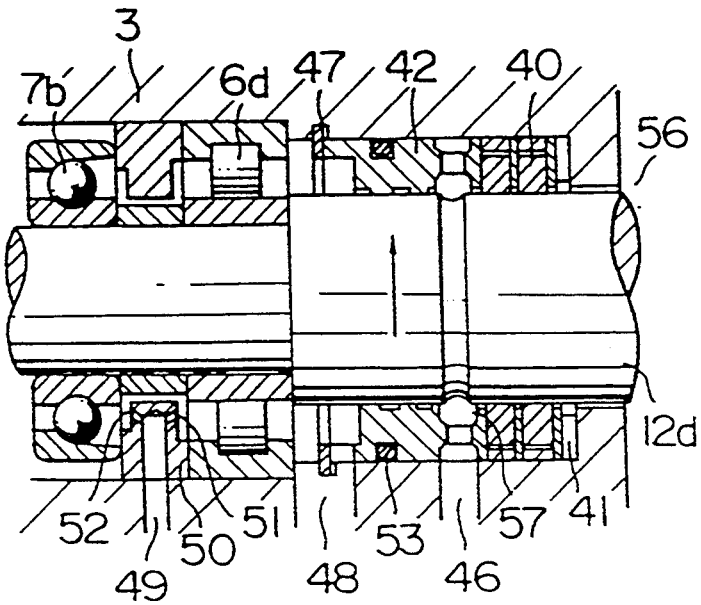
FIG.5 PRIOR ART
FIG. 5 is a view, on an enlarged scale, of the discharge-side shaft portion shown in FIG. 1.
Figure 6:
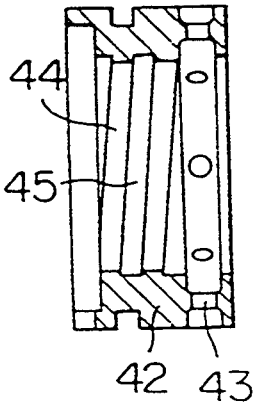
FIG.6 PRIOR ART
FIG. 6 is a sectional view of the stationary screw seal ring shown in FIG. 5.

The turbo-supercharger 111 includes a casing **111*b* having a suction part 111*a* and a runner 111*d* arranged to be rotated in said casing 111*b*. The runner 111*d* has blades 111*c* formed thereon and a shaft 111*e* rotated by a turbine 111*g* shown schematically in FIG. 8. The shaft 111*e* is rotatably supported by an oil-lubricated bearing (not shown) which is arranged at a predetermined position relatively fixed to the casing 111*b*, toward the left side as viewed in FIG. 8. At that part of the casing 111*b* where the shaft 111*e* passes therethrough, there is arranged seal means which is non-contact with the shaft and acts to effect viscosity pumping function, for example, the seal means 21 shown in FIG. 4. A labyrinth seal may be used therefor. The seal means serves to prevent the oil from entering into the casing 111*b***.

The runner **111*d* of the turbo-supercharger 111 rotates at 20000–50000 rpm and acts to suction the air from the atmosphere through the inlet port 111*a* and increase the pressure of the air to 2000–5000 mmAq (0.2–0.5 $Kg/cm^2$ G). The temperature of the air is raised due to the increase of the pressure thereof. The high temperature air is discharged through an outlet port 111*f* and then it passes through an intercooler 112. The intercooler 112 forms an air-cooled type or water-cooled type heat exchanger. In case of the air-cooled type heat exchanger, the air discharged from the turbo-supercharger 111** is cooled to a temperature which is about 3° C.–5° C. higher than the atmospheric temperature, while in case of the water-cooled type heat exchanger, the air is cooled to a temperature which is about 5° C. higher than the cooling water.

Figure 1:
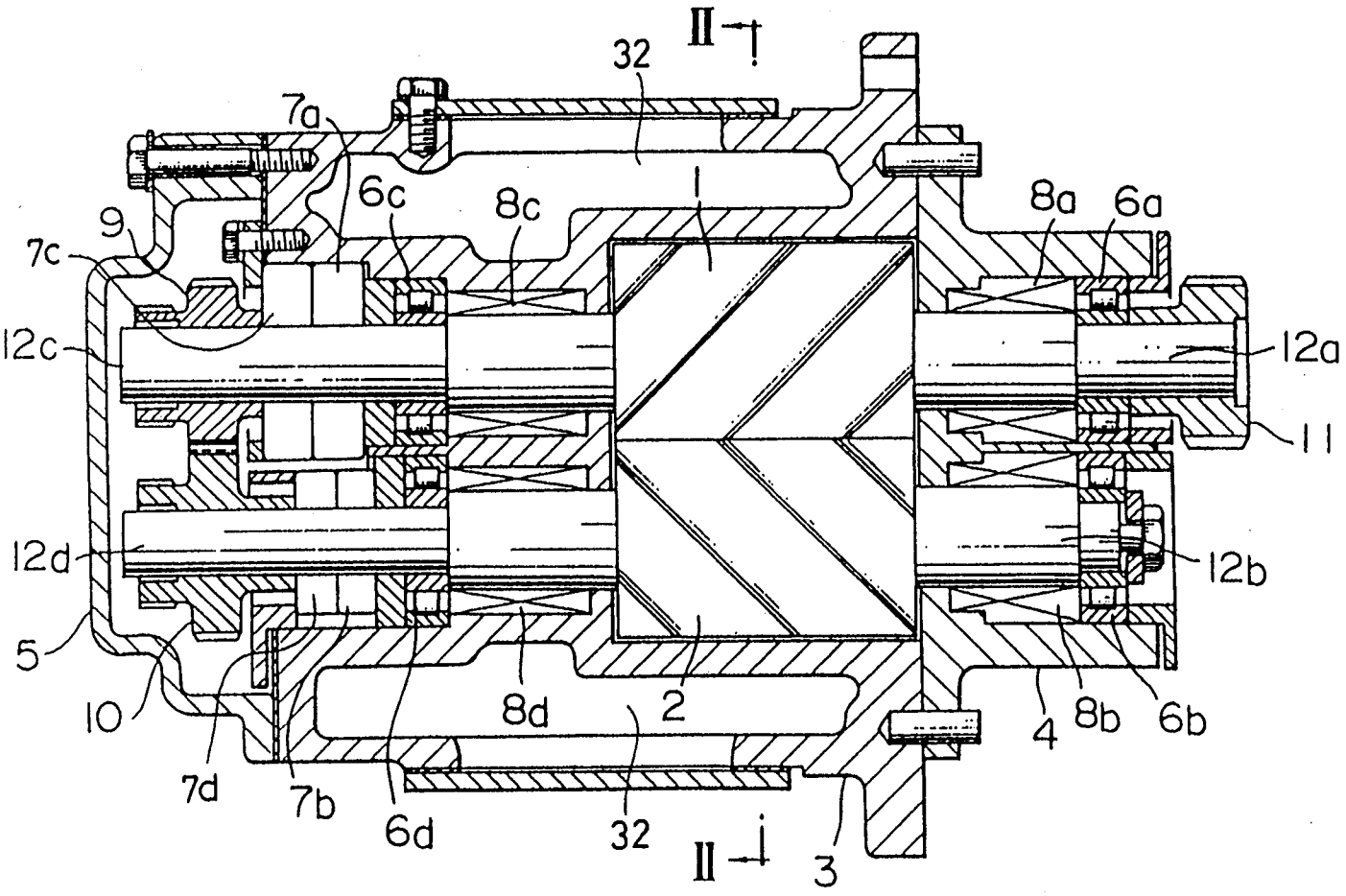
FIG.1 PRIOR ART
FIG. 1 is a transverse sectional view of an oil-free screw compressor according to the prior art.
Figure 2:
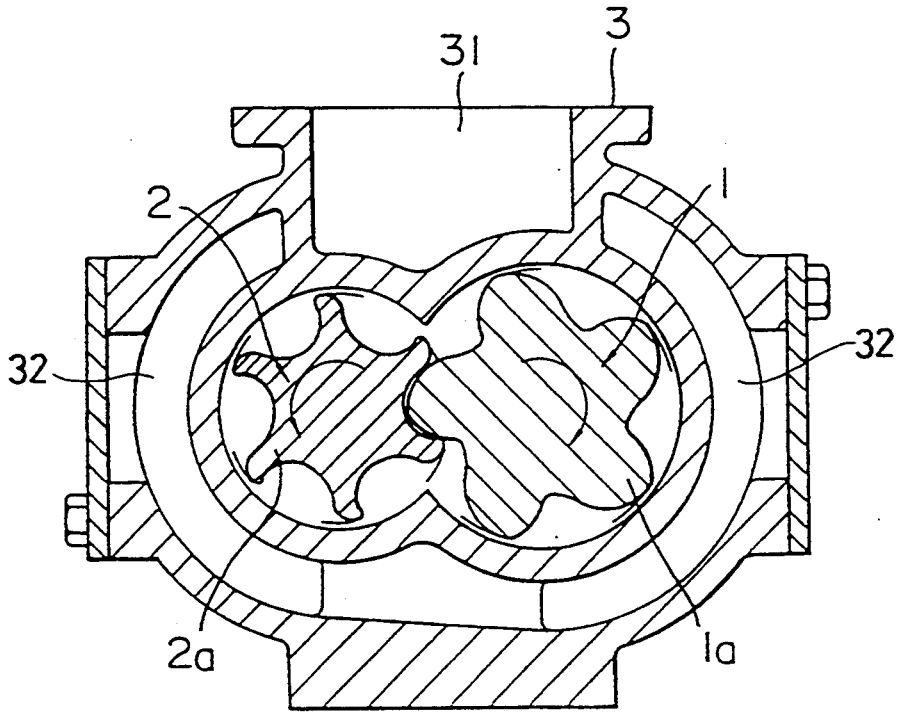
FIG.2 PRIOR ART
FIG. 2 is a sectional view taken along the line II—II in FIG. 1.
Figure 3:
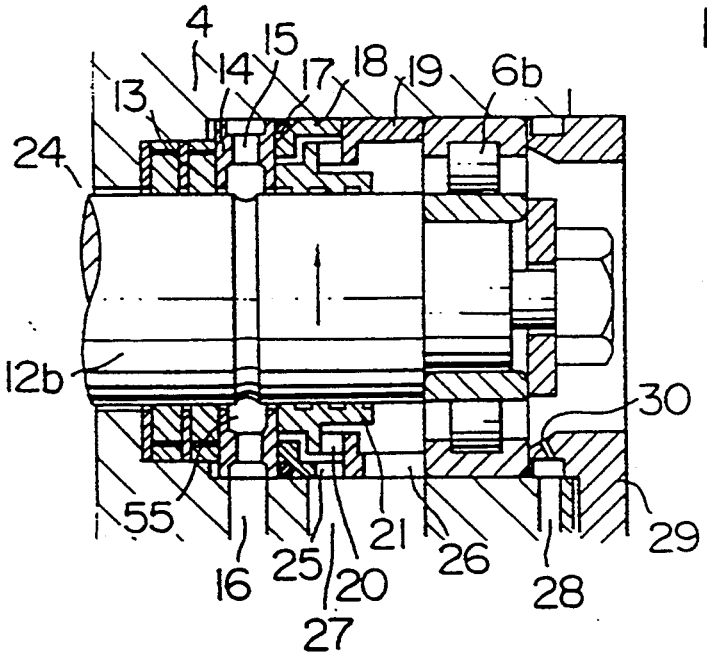
FIG.3 PRIOR ART
FIG. 3 is a view, on an enlarged scale, of the suction-side shaft portion shown in FIG. 1.

The air which has an increased pressure and has been cooled by the intercooler 112 is then suction through an inlet port **101*a* into the oil-free screw compressor 101, which increases the pressure of air to a predetermined pressure (usually, 7 $Kg/cm^2$ G). The air at high temperature and high pressure is passed through a discharge port 101*b* to a pipe 102 and then it is passed through a precooler 103, which serves to cool the air to about 120° C. The air thus cooled is passed through a check valve 104 to an aftercooler 105, which serves to further cool the air to about 55° C., and the cooled air at high pressure is delivered through a discharge pipe 108 to a user side. A fan 109 is used to perform the cooling function of the precooler 103 and the aftercooler 105. The fan 109 is also used to perform cooling function of an oil cooler 106 serving to cool the oil used to lubricate the shaft of the rotor of the oil-free screw compressor 101, such as bearings 6*a*, 6*b*, 6*c* and 6*d* shown in FIG. 1 insert, and a coolant cooler 107 serving to cool the coolant which is passed through the cooling jacket of the oil-free screw compressor 101, that is, the jacket 32 shown in FIG. 1**.

In the embodiment as described above, the combination of the turbo-supercharger 111 and the oil-free screw compressor 101 enables the production of a clean compressed air which is free of oil mist. The compression ratio of the oil-free screw compressor 101 can be considerably decreased to 5.240–6.515, as compared to that of the conventional single-stage oil-free screw compressor which is about 7.786. As the result, the temperature of the air discharged from the oil-free screw compressor 101 can be decreased to about 250° C.–310° C., which is 40° C.–70° C. lower than that of the conventional single-stage oil-free screw compressor. Accordingly, the clearance between the rotors of the oil-free screw compressor can be decreased by about 20–40 μm, whereby the improvement of the performance of the oil-free screw compressor and the lowering of the temperature of the discharged air can be realized.

In the embodiment shown in FIG. 8, the intercooler 112 may be omitted. In case where the intercooler is omitted, the provision of the turbo-supercharger 111 serves to lower the compression ratio of the oil-free screw compressor 101 and to decrease the temperature of the discharged air.

The present invention provides the following technical advantages:

(1) A clean compressed air which is free of oil mist can be produced.

(2) The temperature of the air discharged from the oil-free screw compressor can be considerably lowered to 250° C.–310° C. and, consequently, the clearance between the male rotor and the female rotor and the clearance between these rotors and the casing can be minimized. The limitation concerning the material used is decreased, so that the tolerance in design can be increased and the reliability of the oil-free screw compressor can be considerably increased.

(3) The clearance between the male rotor and the female rotor of the oil-free screw compressor can be decreased by 20–40 $\mu$m and the compression ratio of the compressor can be reduced to 5.24–6,515, with the result that an air leakage through the clearance between the rotors can be considerably reduced. Thus the performance of the oil-free screw compressor is improved and the temperature of the discharged air can be lowered depending upon the lowering of the compression ratio.

(4) The oil-free screw compressor device is of low cost and provides low temperature of the discharged air and high performance.

What is claimed is:

1. A oil-free screw compressor device for producing compressed air from the atmosphere, the oil-free screw compressor device comprising:

an oil-free screw compressor having an air inlet port and a compressed air delivery port; and a turbo-supercharger including a casing having a suctioning port for suctioning air from the atmosphere and increasing the pressure of the suctioned air to a higher pressure of 2000–5000 mm Ag, an air discharge port for discharging said higher pressure air to said inlet port of said oil-free screw compressor, and a runner having a blade rotated in said casing in a non-contact state with said casing.

2. An oil-free screw compressor device for producing compressed air from the atmosphere, the oil-free screw compressor device comprising:

an oil-free screw compressor having an air inlet port and a compressed air delivery port;

a turbo-supercharger including a casing having a suctioning port for suctioning air from the atmosphere and increasing the pressure of the suctioned air to a higher pressure of 2000–5000 mm Ag, an air discharge port for discharging said high pressure air to said air inlet port of said oil-free screw compressor, and a runner having a blade rotated in said casing in a non-contact state with said casing; and an intercooler connected between the discharge port of said turbo-supercharger and the air inlet port of said oil-free screw compressor.

* * * * *